US009421415B2

(12) United States Patent
Chuang et al.

(10) Patent No.: US 9,421,415 B2
(45) **Date of Patent: *Aug. 23, 2016**

(54) ROPE PULLING EXERCISE APPARATUS

(71) Applicants: Lung-Fei Chuang, Taichung (TW); Jin-Chen Chuang, Taichung (TW)

(72) Inventors: Lung-Fei Chuang, Taichung (TW); Jin-Chen Chuang, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 14/994,155

(22) Filed: Jan. 13, 2016

(65) Prior Publication Data

US 2016/0121158 A1 May 5, 2016

Related U.S. Application Data

(63) Continuation of application No. 14/013,046, filed on Aug. 29, 2013.

(30) Foreign Application Priority Data

Mar. 15, 2013 (TW) ..... 102204823 U
May 10, 2013 (TW) ..... 102208756 U

(51) Int. Cl.
*A63B 21/00* (2006.01)
*A63B 21/018* (2006.01)
*A63B 21/02* (2006.01)
*A63B 21/055* (2006.01)

(52) U.S. Cl.
CPC ..... *A63B 21/154* (2013.01); *A63B 21/018* (2013.01); *A63B 21/022* (2015.10); *A63B 21/025* (2013.01); *A63B 21/0552* (2013.01); *A63B 21/0557* (2013.01); *A63B 21/156* (2013.01); *A63B 21/4023* (2015.10); *A63B 21/4031* (2015.10); *A63B 21/4035* (2015.10); *A63B 21/4045* (2015.10); *A63B 2210/50* (2013.01)

(58) Field of Classification Search
CPC A63B 21/04–21/442; A63B 21/154–21/1564; A63B 21/4029–21/4031; A63B 23/02–23/0244; A63B 22/0076–2022/0084
See application file for complete search history.

(56) References Cited

U.S. PATENT DOCUMENTS

| | | | | |
|---|---|---|---|---|
| 6,872,170 | B2 * | 3/2005 | Kuo | A63B 21/028 482/123 |
| 7,771,322 | B1 * | 8/2010 | Batca | A63B 21/153 482/100 |
| 2013/0157818 | A1 * | 6/2013 | Lalaoua | A63B 71/023 482/123 |

* cited by examiner

*Primary Examiner* — Oren Ginsberg
*Assistant Examiner* — Jennifer M Deichl
(74) *Attorney, Agent, or Firm* — CKC & Partners Co., Ltd.

(57) ABSTRACT

A rope pulling exercise apparatus includes an exercise base, a rope base, a pivot base, a pivot-base pulley and a rope. The rope base along an exercise direction has a first end and a second end, and the first end is connected to the exercise base. The pivot base is pivotally joined to the second end of the rope base. A swing direction of the pivot base is relative to the exercise direction. The pivot-base pulley is pivotally connected at the pivot base. The rope has one end connected to the rope base and the other end for pulling along the exercise direction, and the rope is wound around the pivot-base pulley.

14 Claims, 13 Drawing Sheets

ROPE PULLING EXERCISE APPARATUS

RELATED APPLICATIONS

This application is a continuation of U.S. patent application Ser. No. 14/013,046 filed on Aug. 29, 2013, and claims priority to Taiwan Application serial number 102204823, filed Mar. 15, 2013, and Taiwan Application serial number 102208756, filed May 10, 2013, which are herein incorporated by reference.

BACKGROUND

1. Technical Field

The present disclosure relates to an exercise apparatus. More particularly, the present disclosure relates to a rope pulling exercise apparatus.

2. Description of Related Art

Modern life can be very busy and exhausting. Many people are suffering from chronic fatigue because of lack of exercise. All kinds of exercise apparatus are thus invented and produced, to help people develop exercise habit or train different muscle group.

One of the most popular exercise apparatus is the sit-up board. Conventional sit-up board, however, is for only one kind of exercise, sit-up. Repeating the same sit-up exercise can be boring easily. Moreover, limited muscle groups can be trained or exercised provided conventional sit-up board.

Improved sit-up board therefore produced, with all kinds of additional functions. Some sit-up boards can adjust the decline angle. Some sit-up boards include a spring at the backup plate making doing sit-ups more easily. By adjusting or lowering the difficulty of doing exercise, people can enjoy more fun and confidence using the exercise apparatus. Nevertheless, the exercise mode and the muscle group trained are still limited.

Some exercise apparatus further combine multiple exercise machines into one apparatus, to provide versatile exercise mode, such as sit-up, rowing, running, weight training, etc. All these exercise modes can't be performed at one time though. One exercise is to be performed at one time. As a result, the muscle group trained is still limited in each exercise session. And since these exercises are standard and common, it can get boring easily and not ideal for those who start on developing an exercise hobby. Furthermore, usually this kind of "versatile" exercise apparatus are designed for intense training, but not for people who want to relaxing and developing an exercise hobby. When people get bored or frustrated, the exercise hobby can be difficult to cultivate.

SUMMARY

According to one embodiment of the present disclosure, a rope pulling exercise apparatus includes an exercise base, a rope base, a pivot base, a pivot-base pulley, a rope and a backrest rotatably. The rope base along an exercise direction has a first end and a second end, and the first end is connected to the exercise base. The pivot base is pivotally joined to the second end of the rope base. A swing direction of the pivot base is relative to the exercise direction. The pivot-base pulley is pivotally connected at the pivot base. The rope has one end connected to the rope base and the other end for pulling along the exercise direction, and the rope is wound around the pivot-base pulley. The backrest rotatably is disposed on the exercise base, and the backrest is driven synchronously with the rope.

According to another embodiment of the present disclosure, a rope pulling exercise apparatus includes an exercise base, a rope base, two pulling sets and a backrest. The rope base along an exercise direction has a first end and a second end. The first end is connected to the exercise base. The two pulling sets are disposed side by side at the rope base. Each pulling set further includes a pivot base, a pivot-base pulley, and a rope. The pivot base is pivotally joined to the second end of the rope base, and a swing direction of the pivot base is relative to the exercise direction. The pivot-base pulley is pivotally connected to the pivot base. The rope has one end connected to the rope base and the other end for pulling along the exercise direction. The rope is wound around the pivot-base pulley. The backrest rotatably is disposed on the exercise base, and the backrest is driven synchronously with the rope.

According to yet another embodiment of the present disclosure, a rope pulling exercise apparatus includes an exercise base, a rope base, two pulling sets and a backrest rotatably. The rope base along an exercise direction has a first end and a second end. The first end is connected to the exercise base, and the first end has a fixing part for determining a predetermined angle between the rope base and the exercise base. The two pulling sets are disposed side by side at the rope base. Each pulling set includes a pivot base, a pivot-base pulley, at least one intermediary pulley, a rope, and a pulling handle. The pivot base is pivotally joined to the second end of the rope base, and a swing direction of the pivot base is relative to the exercise direction. The pivot-base pulley is pivotally connected to the pivot base. The intermediary pulley is pivotally disposed at the first end or the second end of the rope base. The rope has one end connected to the rope base and the other end for pulling along the exercise direction. And the rope is wound around the intermediary pulley and the pivot-base pulley. The pulling handle is connected to the other end of the rope. The backrest rotatably is disposed on the exercise base, and the backrest is driven synchronously with the rope.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
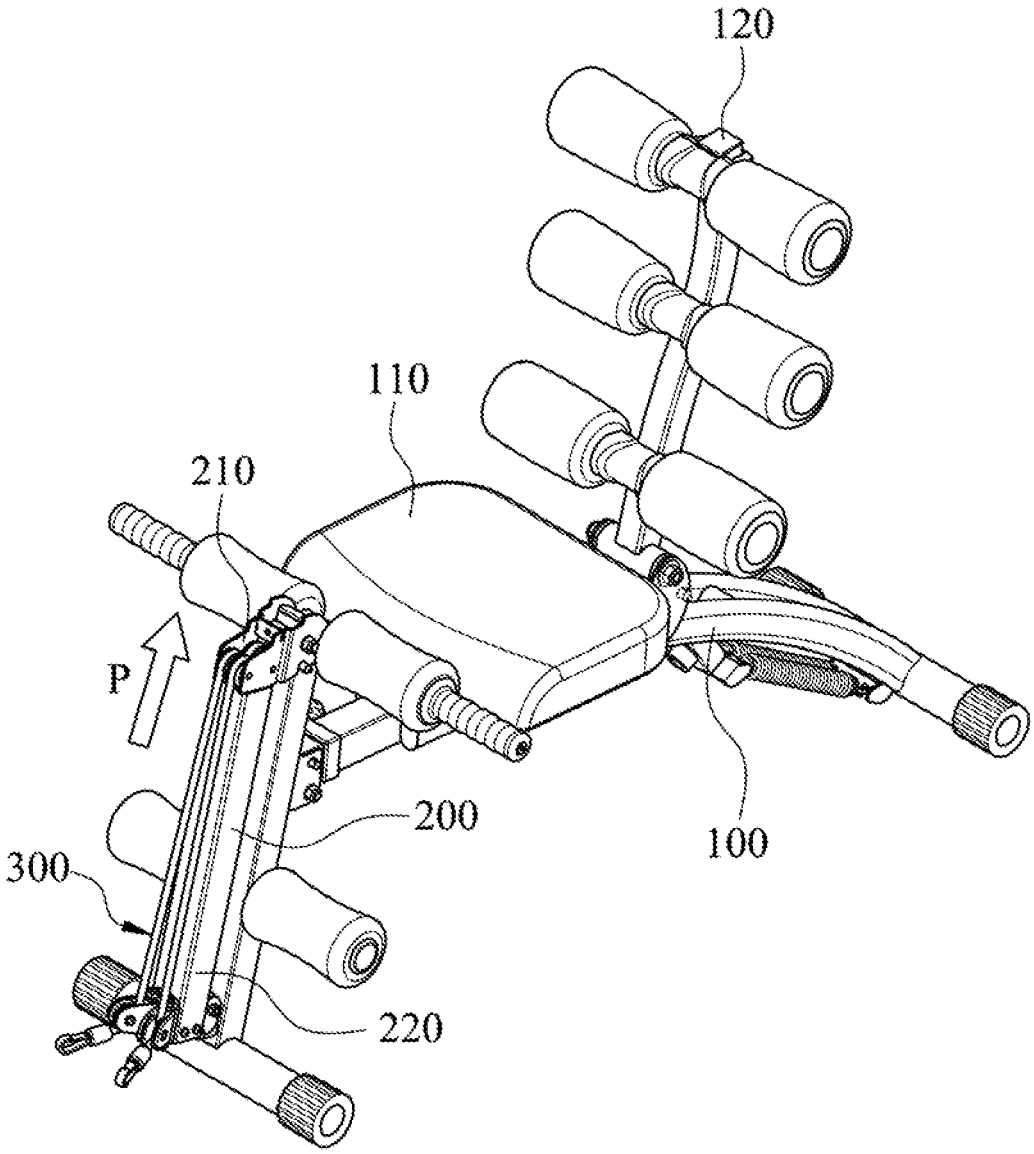
FIG. 1 is a perspective view of a rope pulling exercise apparatus according to one embodiment of the present disclosure.
Figure 2:
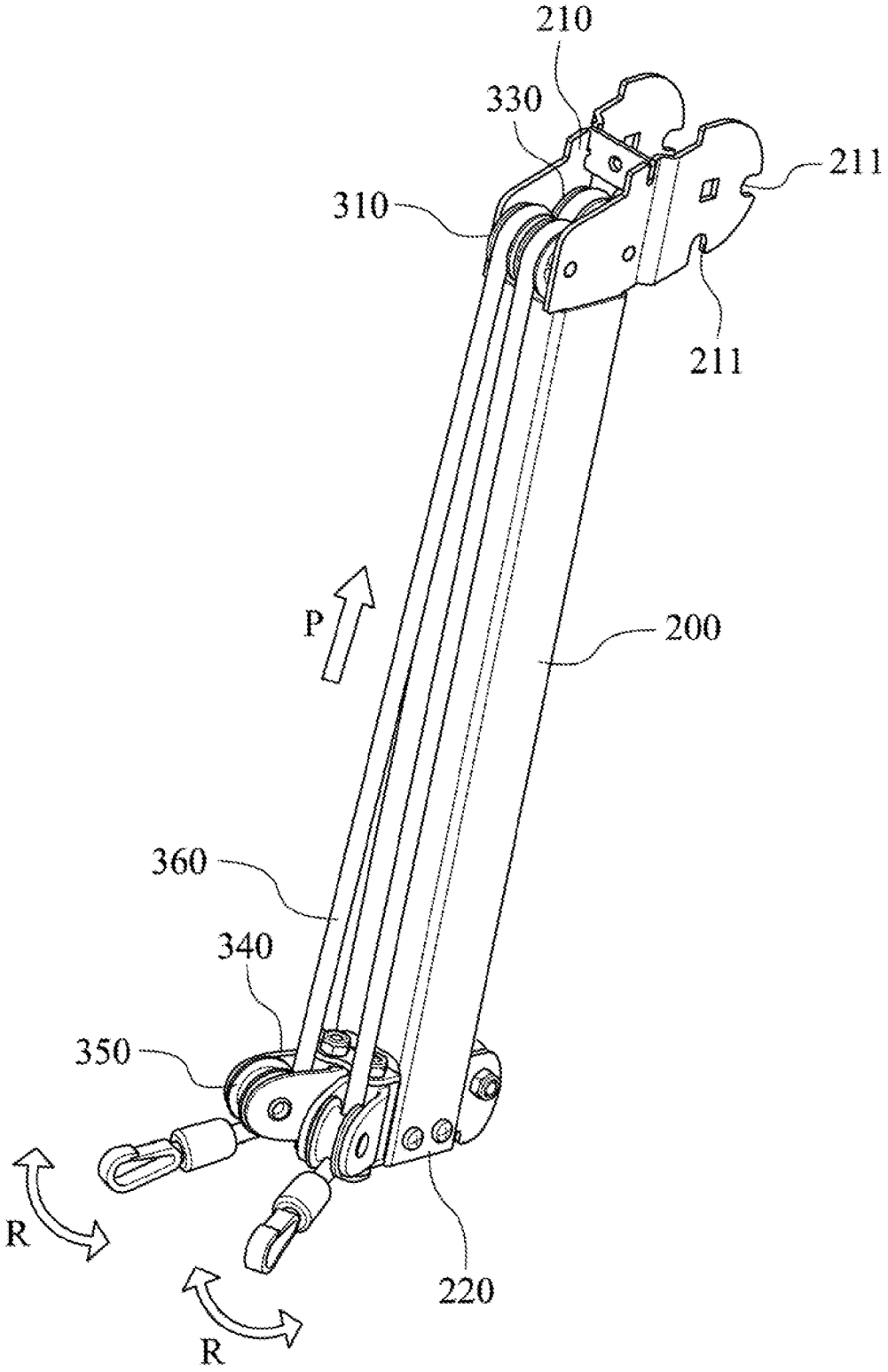
FIG. 2 is a partial perspective view of the rope base and the pulling sets of the rope pulling exercise apparatus of FIG. 1.
Figure 3:
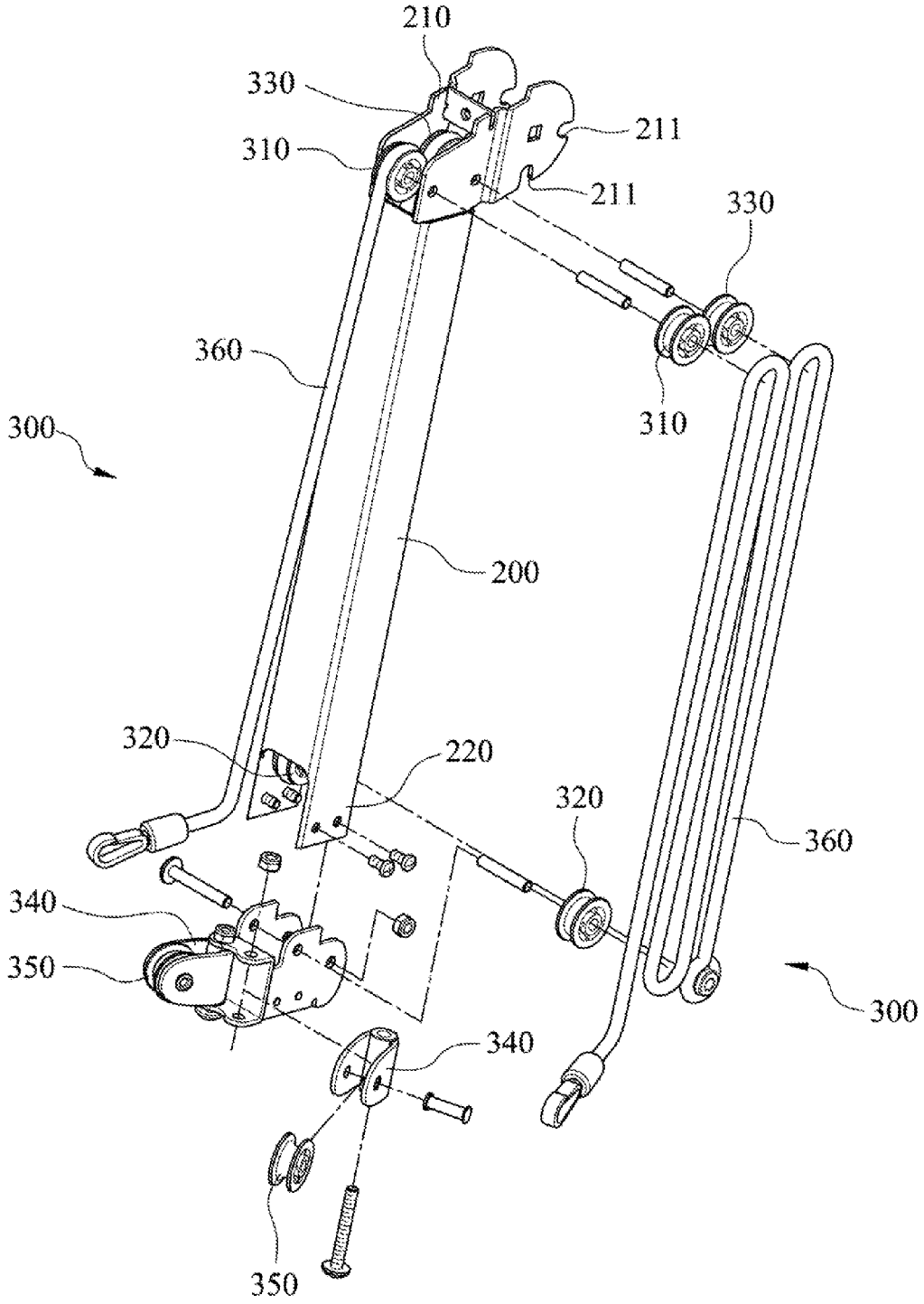
FIG. 3 is an exploded view of the rope base and the pulling sets of FIG. 2.
Figure 4:
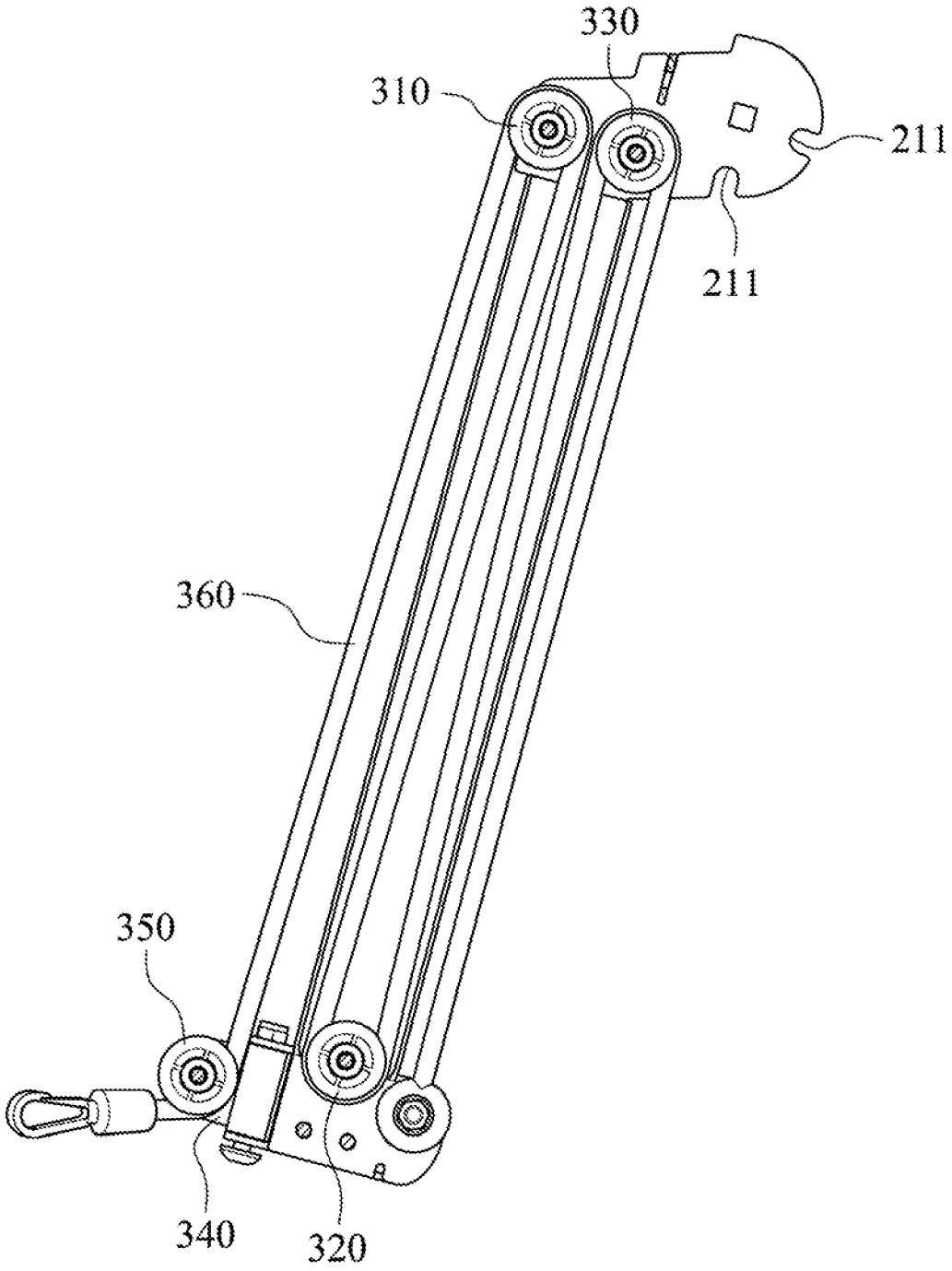
FIG. 4 is a cross-sectional view of the rope base and the pulling sets of FIG. 2.

FIG. 1 is a perspective view of a rope pulling exercise apparatus according to one embodiment of the present disclosure. FIG. 2 is a partial perspective view of a rope base 200 and two pulling sets 300 of the rope pulling exercise apparatus of FIG. 1. FIG. 3 is an exploded view of FIG. 2. FIG. 4 is a cross-sectional view of FIG. 2.

The rope pulling exercise apparatus includes an exercise base 100, the rope base 200, and the pulling sets 300. The exercise base 100 can include a seat 110 and a backrest 120, for performing sit-up exercise. The rope base along an exercise direction P has a first end 210 and a second end 220. The first end 210 is pivotally connected to the exercise base 100. The pulling sets 300 are disposed side by side at the rope base 200.

Each pulling set 300 further includes three intermediary pulleys, a pivot base 340, a pivot-base pulley 350, and a rope 360. The three intermediary pulleys are a first intermediary pulley 310, a second intermediary pulley 320, and a third intermediary pulley 330. The first intermediary pulley 310 is pivotally disposed at the first end 210 of the rope base 200. The second intermediary pulley 320 is pivotally disposed at the second end 220 of the rope base 200. And the third intermediary pulley 330 is pivotally disposed at the first end 210 of the rope base 200. An axial direction of the first intermediary pulley 310 and an axial direction of the third intermediary pulley 330 are parallel.

The pivot base 340 is pivotally joined to the second end 220 of the rope base 200, and a swing direction R of the pivot base is relative to the exercise direction P. The pivot-base pulley 350 is pivotally connected to the pivot base 340. The rope 360 has one end connected to the rope base 200, and the rope 360 is wound around the pulleys in an order of the third intermediary pulley 330, the second intermediary pulley 320, the first intermediary pulley 310, and the pivot-base pulley 350. The other end of the rope 360 is for pulling along the exercise direction P.

When a user pulling the rope 360 along the exercise direction P, the pulling direction may be varied due to human's fatigue and unstable force output. As the pulling direction varying, the pivot base 340 can swing along the swing direction R, thus prevent the rope 360 from robbed. As a result, the wear of the rope 360 can be greatly prevented, and the life of the rope pulling exercise apparatus can be prolonged.

Furthermore, the rope 360 can be an elastic rope. The first end 210 of the rope base 200 can further have two fixing part 211, for determining a predetermined angle between the rope base 200 and the exercise base 100. It is worth to notice that the exercise base 100 does not require the seat 110 or the backrest 120. The exercise base 100 would be efficient as far as being able to perform sit-up exercise.

Moreover, this embodiment of the rope pulling exercise apparatus shown in FIGS. 1-4 adopts three intermediary pulleys, namely the first intermediary pulley 310, the second intermediary pulley 320, and the third intermediary pulley 330. The quantity of the intermediary pulleys, however, is not limited by three, but can be three, two, one, or more than three. Other embodiments will be illustrated later.

Figure 5:
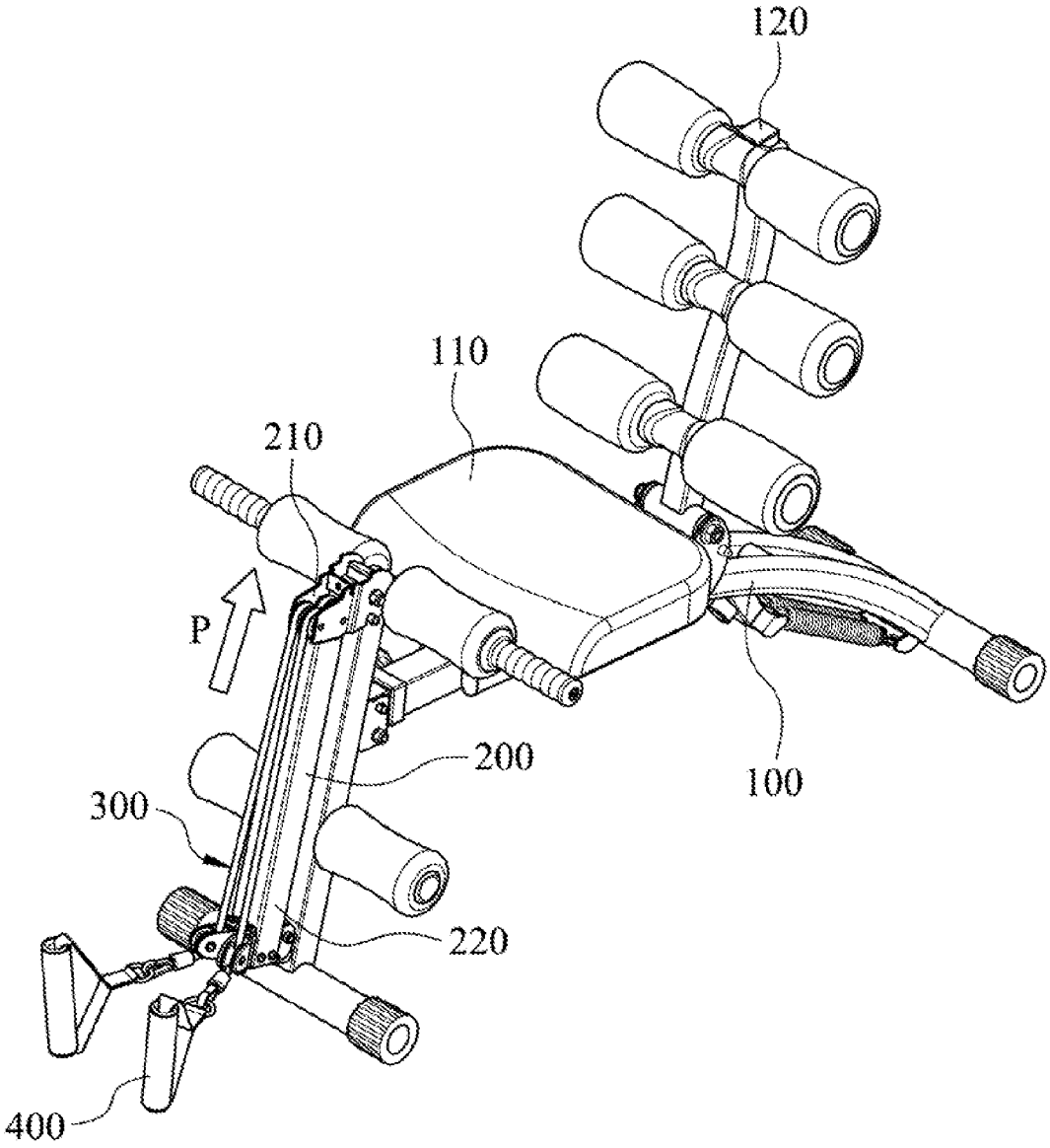
FIG. 5 is a perspective view of a rope pulling exercise apparatus according to another embodiment of the present disclosure.

FIG. 5 is a perspective view of a rope pulling exercise apparatus according to another embodiment of the present disclosure. In addition to the structure shown in FIG. 1, the rope pulling exercise apparatus can further includes a pulling handle 400. The pulling handle 400 can be connected to the other end of the rope 360. The pulling handle 400 is for being gripped by the user to pull the rope 360 for exercising.

Figure 6:
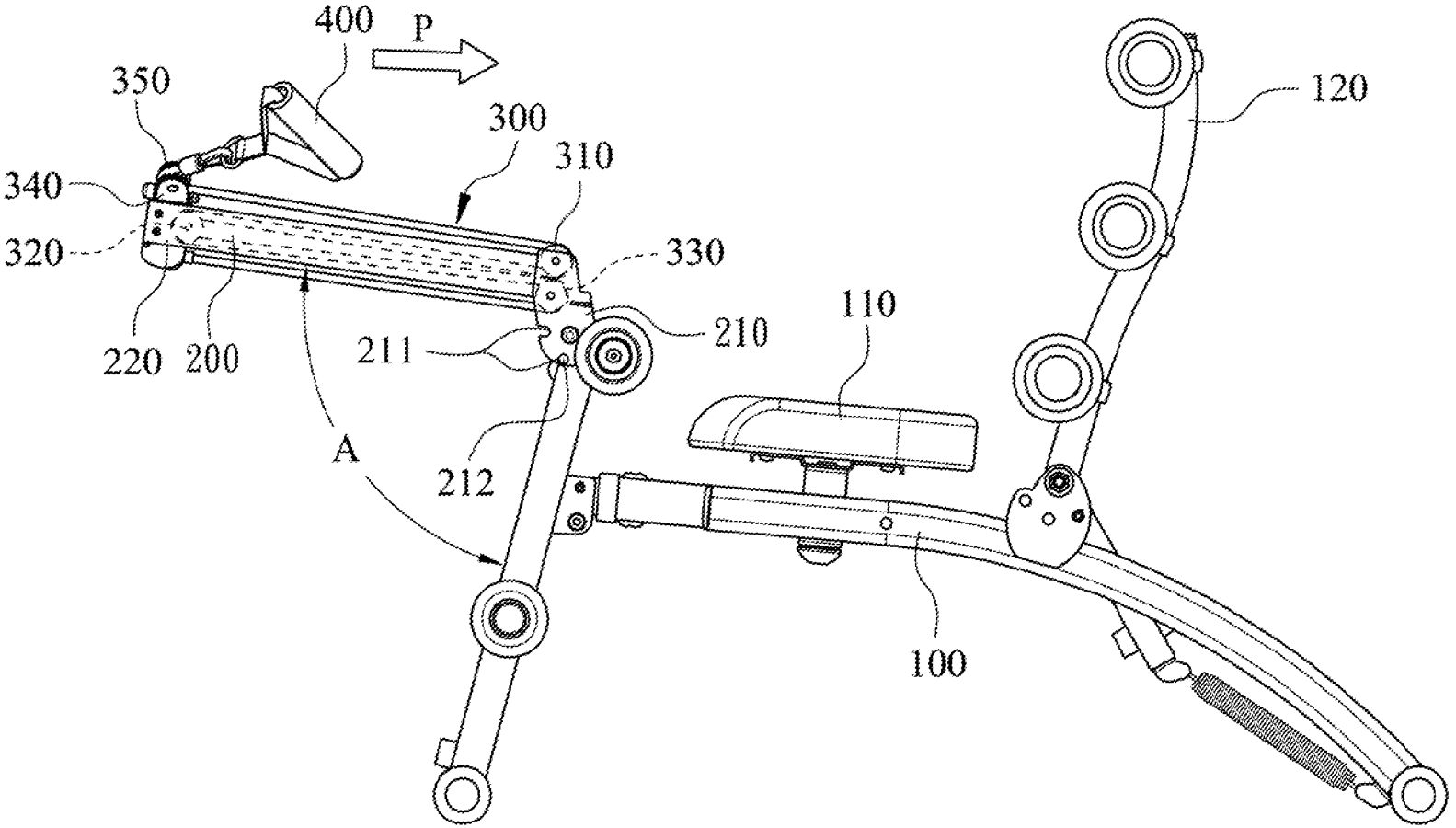
FIG. 6 is a cross-sectional view of FIG. 5 in an operation state.

FIG. 6 is a cross-sectional view of FIG. 5 in an operation state. The first end 210 of the rope base 200 can further have two fixing parts 211. Each fixing part 211 is for fixing the rope base 200 to the exercise base 100, so that the angle between the rope base 200 and the exercise base 100 can be a predetermined angle A. The fixing part 211 can be a slot or a hole. A pin 212 is also adopted to engage the fixing part 211, so that the rope base 200 can be fixed to the exercise base 100 with the predetermined angle A. The user can sit on the seat 110, rest his/her back on the backrest 120, and grip the pulling handle 400.

Figure 7:
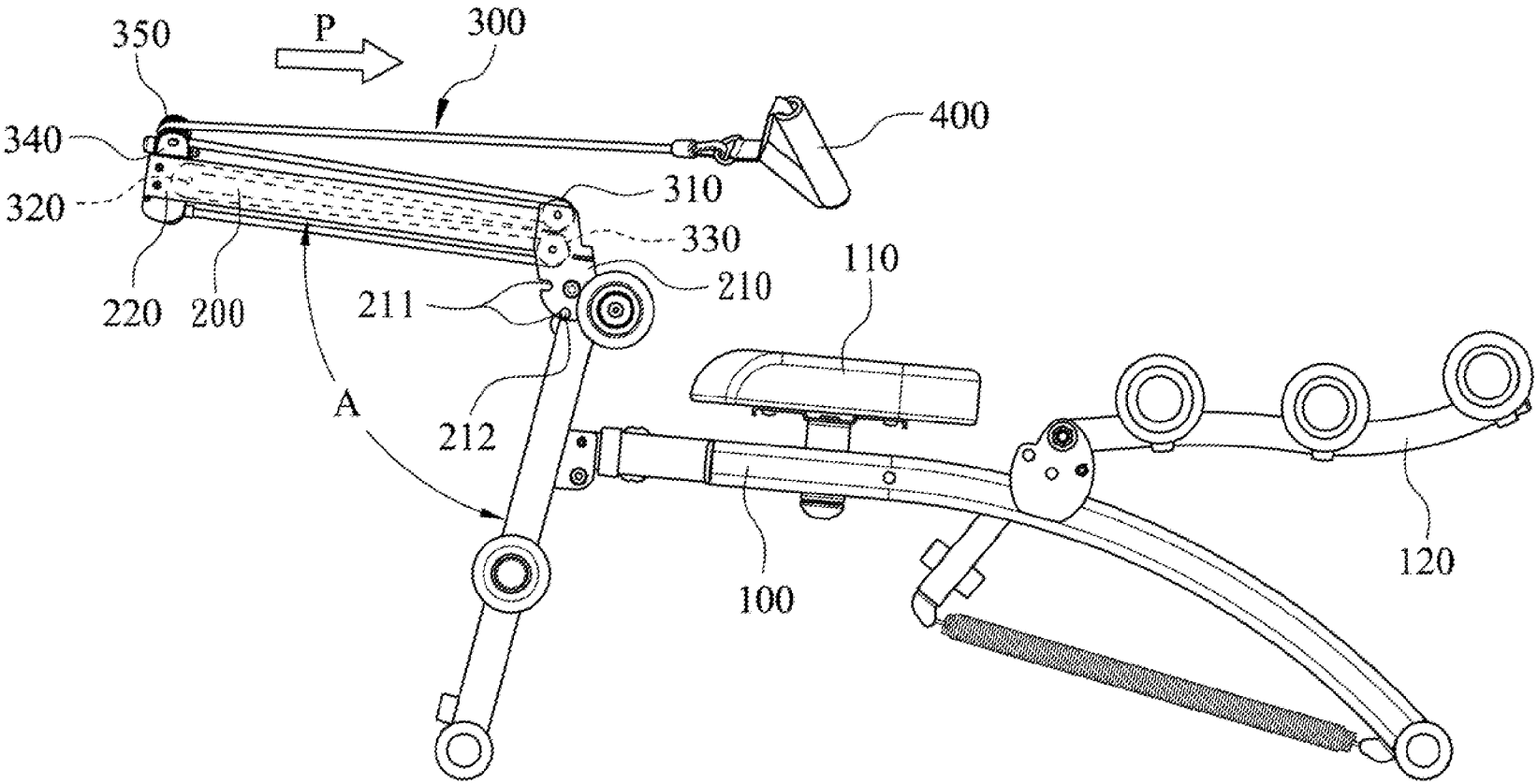
FIG. 7 is a cross-sectional view of FIG. 5 in another operation state.

FIG. 7 is a cross-sectional view of FIG. 5 in another operation state. Following the operation state shown in FIG. 6, the user sits on the seat 110, lies down by pushing the backrest 120 down, and pulls the rope 360 by pulling the pulling handle 400 approximately in the exercise direction P. In brief, the backrest is pivoted on the exercise base so can be rotated by human's body, when the user pulls the rope 360, the backrest will be clockwisely rotated. Thus the user can perform the exercise of lying down and rope pulling at the same time.

Attached Appendix 1 is the exercise program study for the embodiment of the present disclosure, and Appendix 2 is the testing report for the exercise program of Appendix 1. Please refer to tables 1a and 1b in Appendix 2, being considered with the condition that subjects only row the rope, rowing and leaning back simultaneously can produce greater muscle activity. Especially, in table 1a and 1b, the percentage difference between the two conditions of muscle activity of brachii and rectus are 123% and 220% for female, and 293% and 468% for male.

Moreover, in tables 2a and 2b in Appendix 2, doing crunches with leaning back can also produce greater muscle activity than doing the standard floor crunches.

The exercise of lying down mentioned above can be the lying part of the exercise sit-up. Therefore the user can exercise sit-up and rope pulling at the same time. It is worth to notice that the present disclosure is not limited for sit-up exercise. The present disclosure can be applied to any exercise required lying down. Hence the user can perform the exercise of lying down or stretching, and do rope pulling at the same time. Also, the exercise base 100 is not limited by the drawing, the exercise base 100 can be a sit-up board, a flat board, a curved board, a chair which is able to be leaning backward, a apparatus which is able to perform leaning backward. For example, an office chair can suffice as an exercise base 100. Adopting the present disclosure to an office chair, so that a user can relax and stretch and pull the rope to exercise whenever he/she was tired just sitting.

The pulling handle 400 is for pulling the rope 360. The pulling handle, however, is not limited by a hand grip. The pulling handle 400 can also be a mechanism to be fixed to the user's arm, shoulder, or limb. The pulling handle 400 is sufficient as long as being used for user to perform rope pulling. The handle 400 can be removable from the rope 360. Therefore the handle 400 can be supplied with varies types, and the user can attach different type of handle to the rope 360 in different situation. Exercise versatility for rope pulling thus is provided.

The pivot-base pulley 350 is pivotally connected to the pivot base 340. Thus when pulling the rope 360 to perform rope pulling exercise, the rope 360 can swing the pivot base 340 in swing direction R. (Please refer to FIG. 2.) So the rope 360 won't be wear easily. And the user can pull the rope 360 with smaller resistance, since the rope 360 won't be robbed by other element. The rope pulling exercise therefore can be performed more smoothly.

Furthermore, the first intermediary pulley 310, the second intermediary pulley 320, the third intermediary pulley 330, and the pivot-base pulley 350 are all installed around the outer edge of the rope pulling exercise apparatus, so it is easy and convenient to repair or replace these parts. Only few elements needed to be uninstalled to reach the intermediary pulleys and the pivot-base pulley 350.

Figure 8:
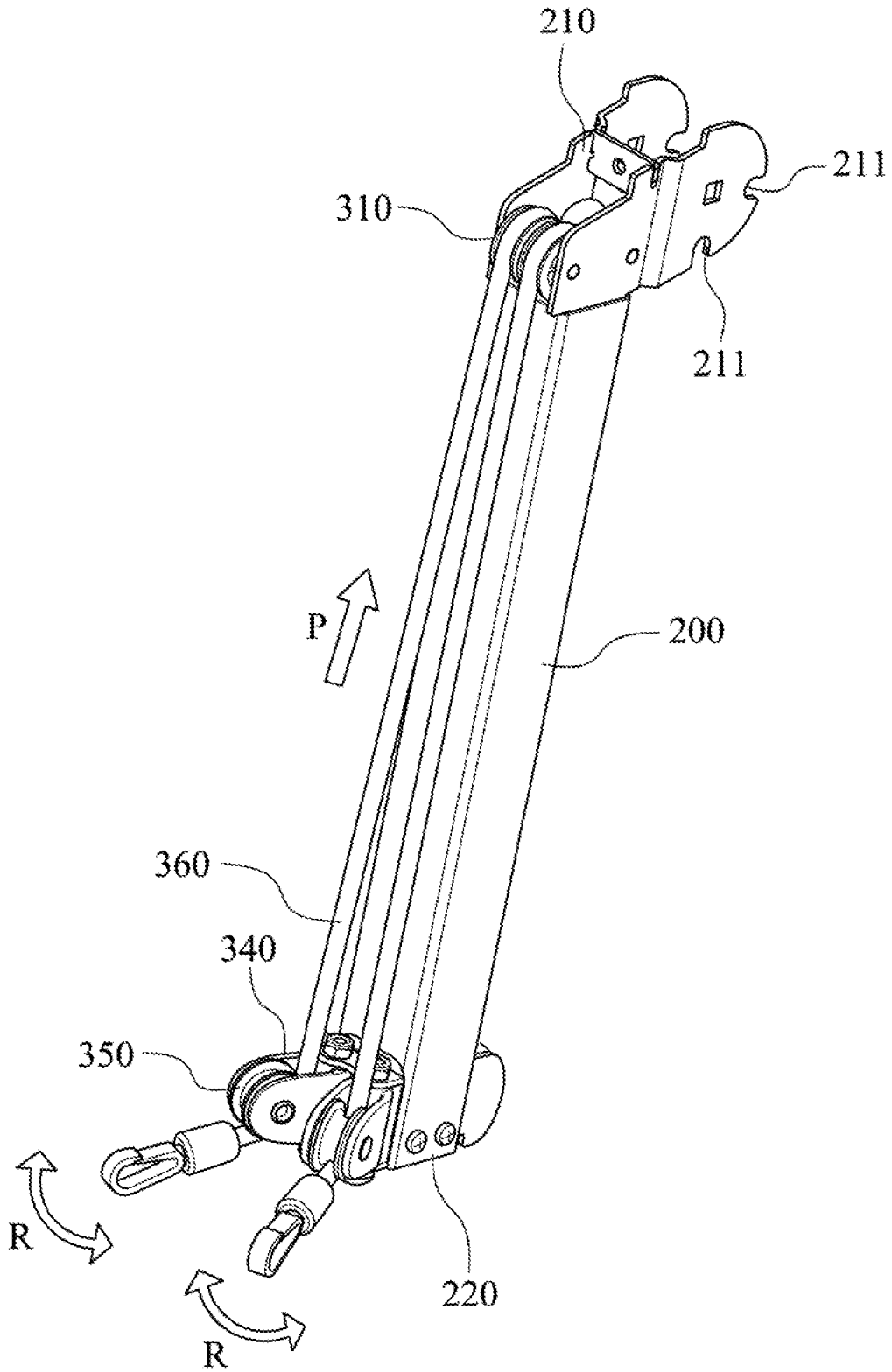
FIG. 8 is a partial perspective view of the rope base and the pulling sets of a rope pulling exercise apparatus according to yet another embodiment of the present disclosure.
Figure 9:
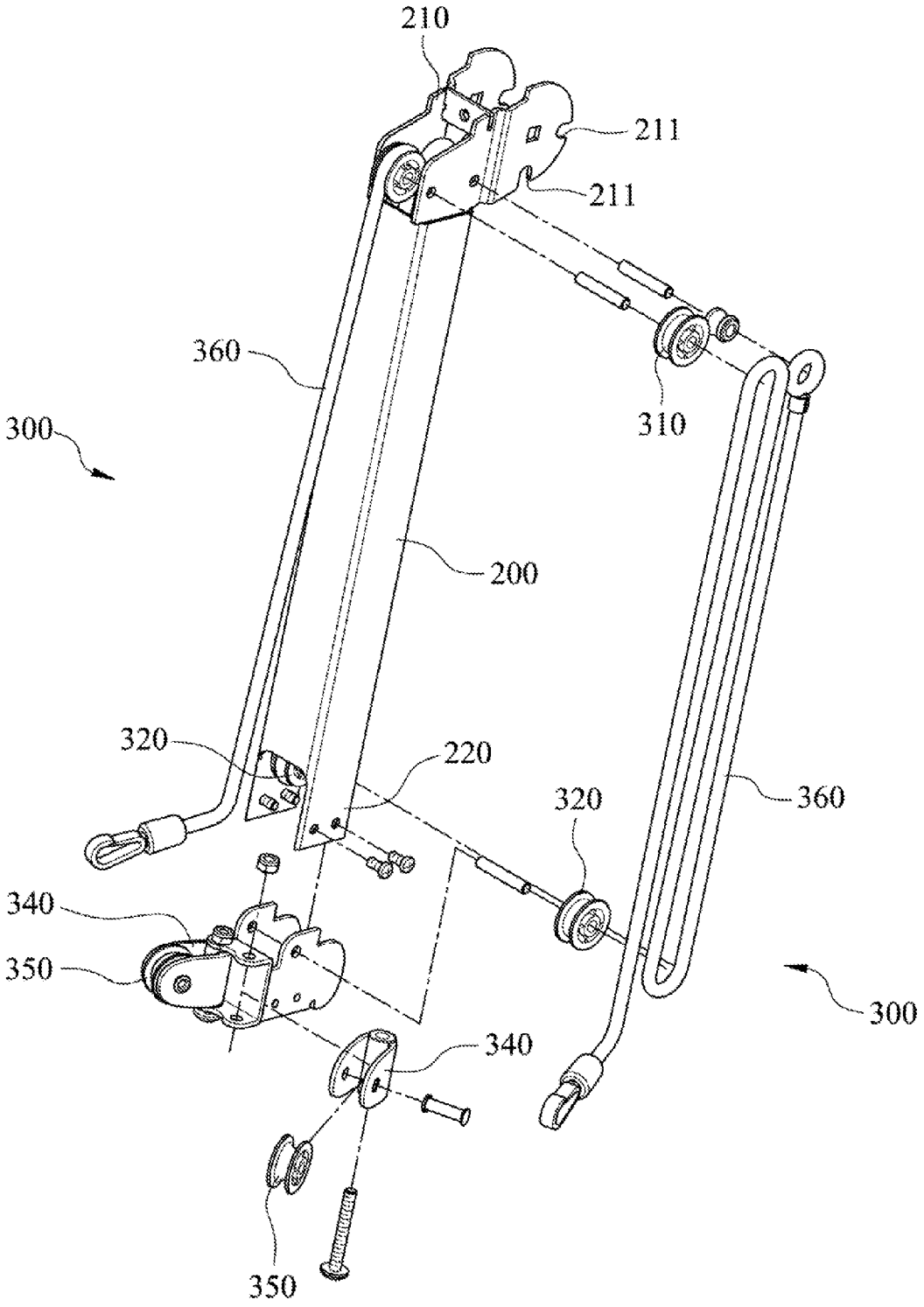
FIG. 9 is an exploded view of FIG. 8.

FIG. 8 is a partial perspective view of the rope base 200 and the pulling sets 300 of a rope pulling exercise apparatus according to another embodiment of the present disclosure. FIG. 9 is an exploded view of FIG. 8. Each pulling set 300 in the rope pulling exercise apparatus shown in FIG. 8-9 includes two intermediary pulleys. The two intermediary pulleys are a first intermediary pulley 310 and a second intermediary pulley 320. Other elements with the same number are the same as mentioned before.

The first intermediary pulley 310 can be disposed at the first end 210 of the rope base 200. The second intermediary pulley 320 can be disposed at the second end 220 of the rope base 200. The rope 360 can be connected to the first end 210 of the rope base 200. The rope 360 is from the fixing location to extend along the exercise direction P and wound around in the order of the second intermediary pulley 320, the first intermediary pulley 310, and the pivot-base pulley 350. Each pulling set 300 can further includes a pulling handle (not shown). The pulling sets 300 can be installed in a rope pulling exercise apparatus shown as FIG. 1 or FIG. 5 to replace the original pulling sets 300. Thus the operation is similar to FIGS. 6-7 and need not to be explained again here.

The embodiment disclosed in FIGS. 8 and 9 can also provide a user to exercise sit-up and rope pulling at the same time. The pivot base 340 can also swing in the swing direction R. So the rope 360 won't be wear easily. And the user can pull the rope 360 with smaller resistance, since the rope 360 won't be robbed by other element. The rope pulling exercise therefore can be performed more smoothly. Moreover, the intermediary pulleys are installed around the outer edge of the rope pulling exercise apparatus, so it is easy and convenient to repair or replace the intermediary pulleys or parts. Only few elements needed to be uninstalled to reach the intermediary pulleys and the pivot-base pulley 350.

Figure 10:
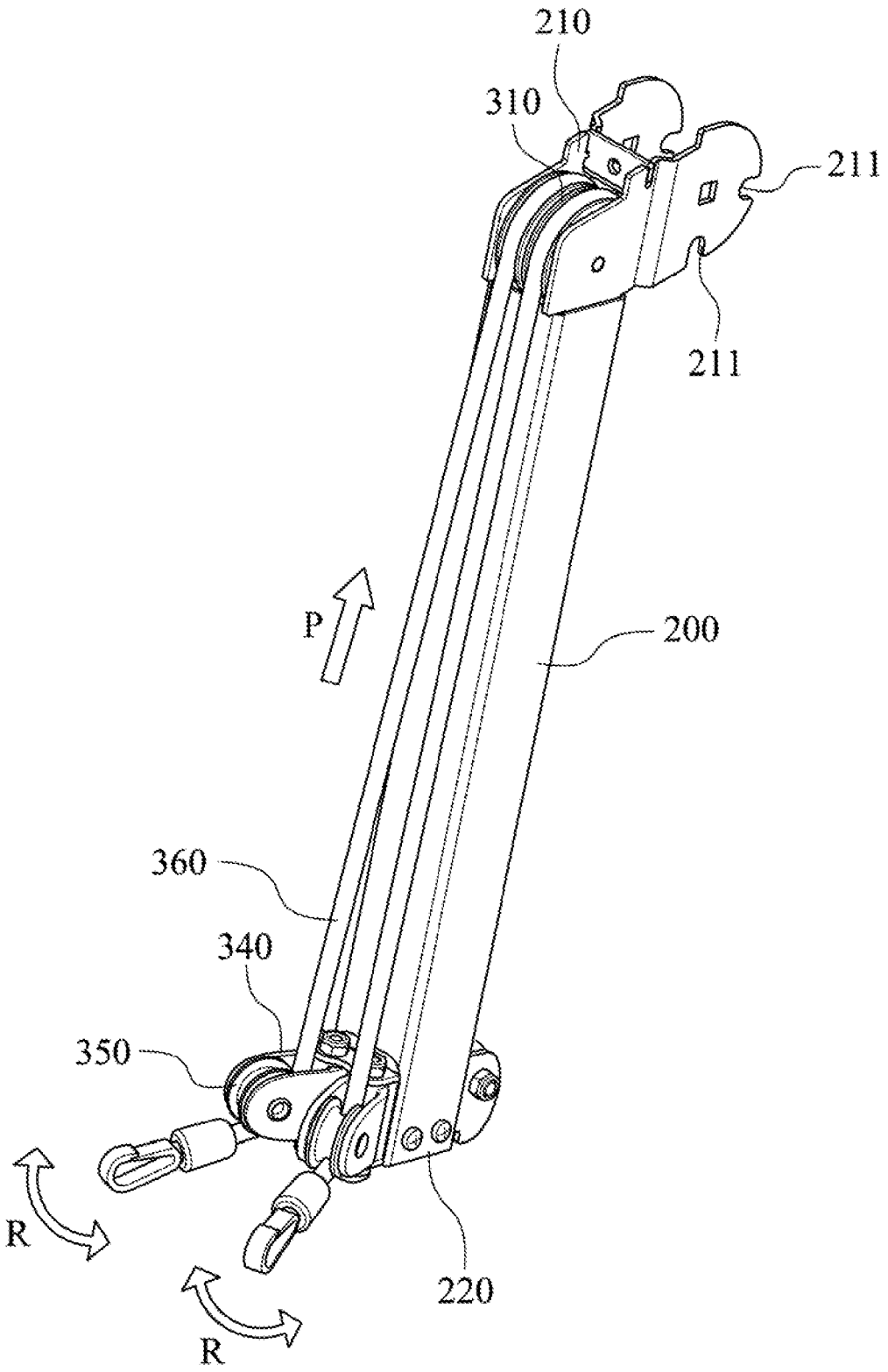
FIG. 10 is a partial perspective view of the rope base and the pulling sets of a rope pulling exercise apparatus according to another embodiment of the present disclosure.
Figure 11:
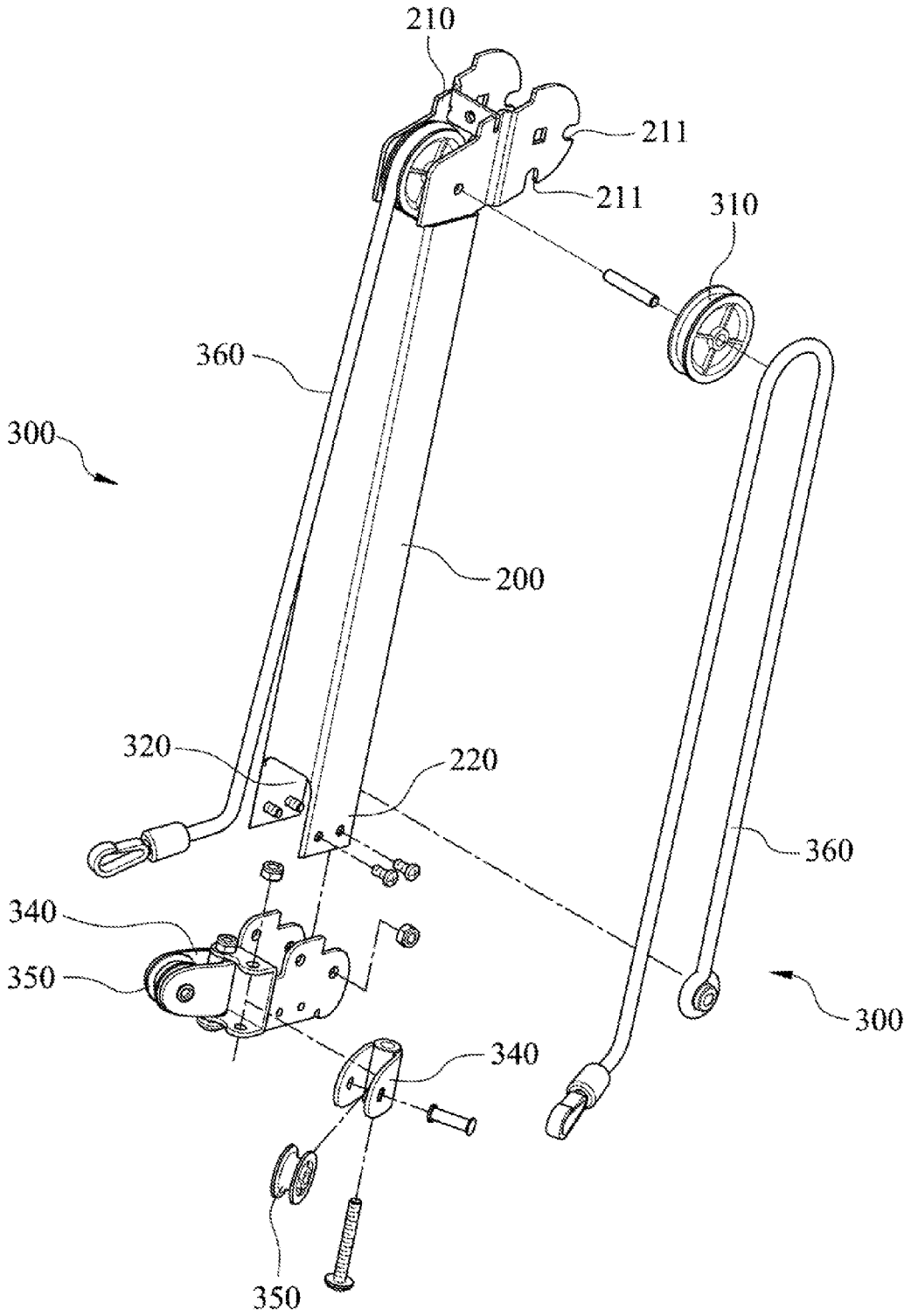
FIG. 11 is an exploded view of FIG. 10.

FIG. 10 is a partial perspective view of the rope base 200 and the pulling sets 300 of a rope pulling exercise apparatus according to another embodiment of the present disclosure. FIG. 11 is an exploded view of FIG. 10. Each pulling set 300 in the rope pulling exercise apparatus shown in FIGS. 10 and 11 includes only one intermediary pulley, namely a first intermediary pulley 310. Other elements with the same number are the same as mentioned before.

The first intermediary pulley 310 can be disposed at the first end 210 of the rope base 200. The rope 360 can be connected to the second end 220 of the rope base 200. The rope 360 is from the fixing location to extend along the exercise direction P and wound around in the order of the first intermediary pulley 310 and the pivot-base pulley 350. Each pulling set 300 can further includes a pulling handle (not shown). The pulling sets 300 can be installed in a rope pulling exercise apparatus shown as FIG. 1 or FIG. 5 to replace the original pulling sets 300. Thus the operation is similar to FIGS. 6-7 and need not to be explained again here.

The embodiment disclosed in FIGS. 10 and 11 can also provide a user to exercise sit-up and rope pulling at the same time. The pivot base 340 can also swing in the swing direction R. So the rope 360 won't be wear easily. And the user can pull the rope 360 with smaller resistance, since the rope 360 won't be robbed by other components. The rope pulling exercise therefore can be performed more smoothly. Moreover, the intermediary pulley is installed around the outer edge of the rope pulling exercise apparatus, so it is easy and convenient to repair or replace the intermediary pulley or other parts. Only few elements needed to be uninstalled to reach the intermediary pulley and the pivot-base pulley 350.

Figure 12:
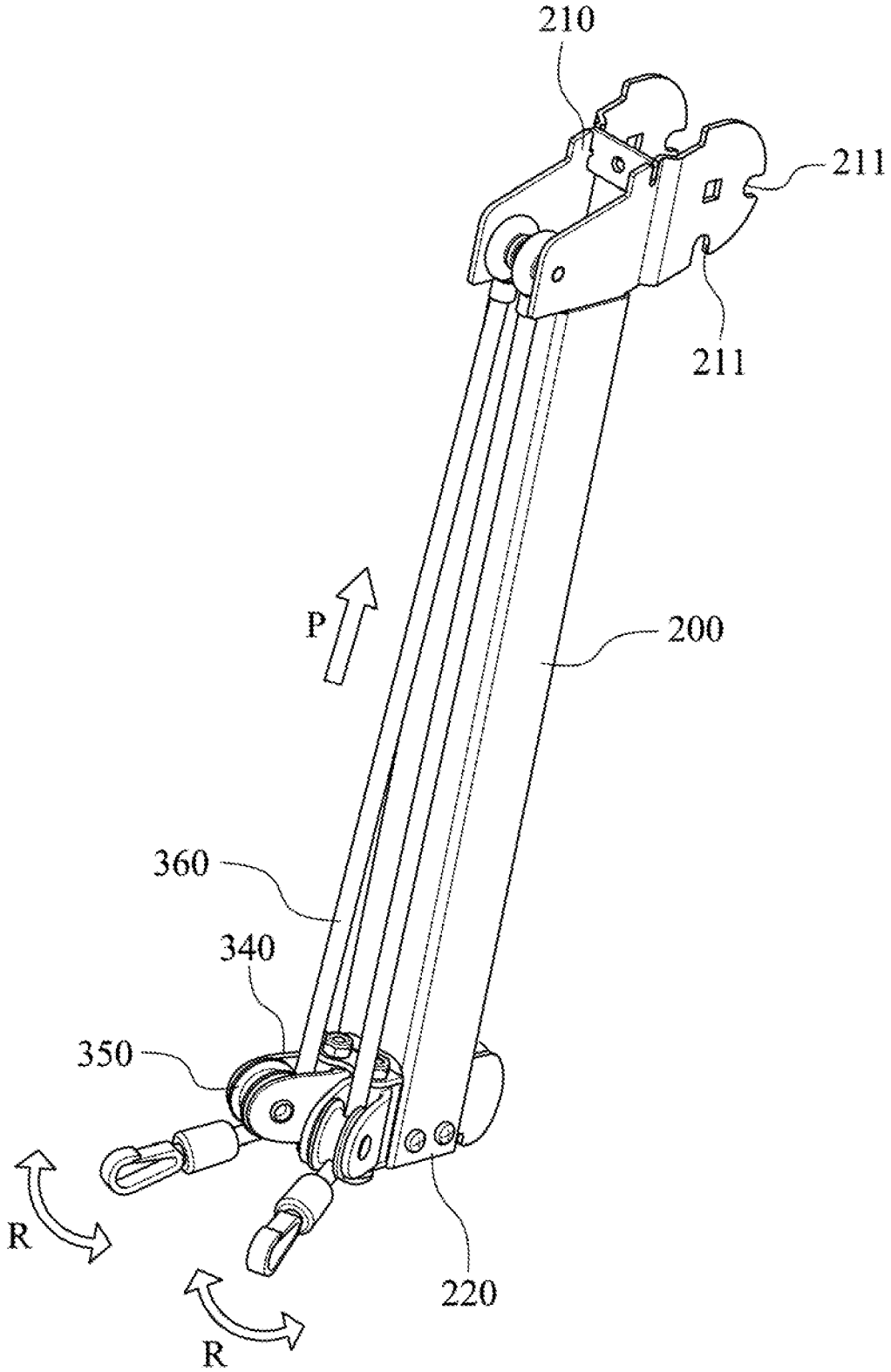
FIG. 12 is a partial perspective view of the rope base and the pulling sets of a rope pulling exercise apparatus according to another embodiment of the present disclosure.
Figure 13:
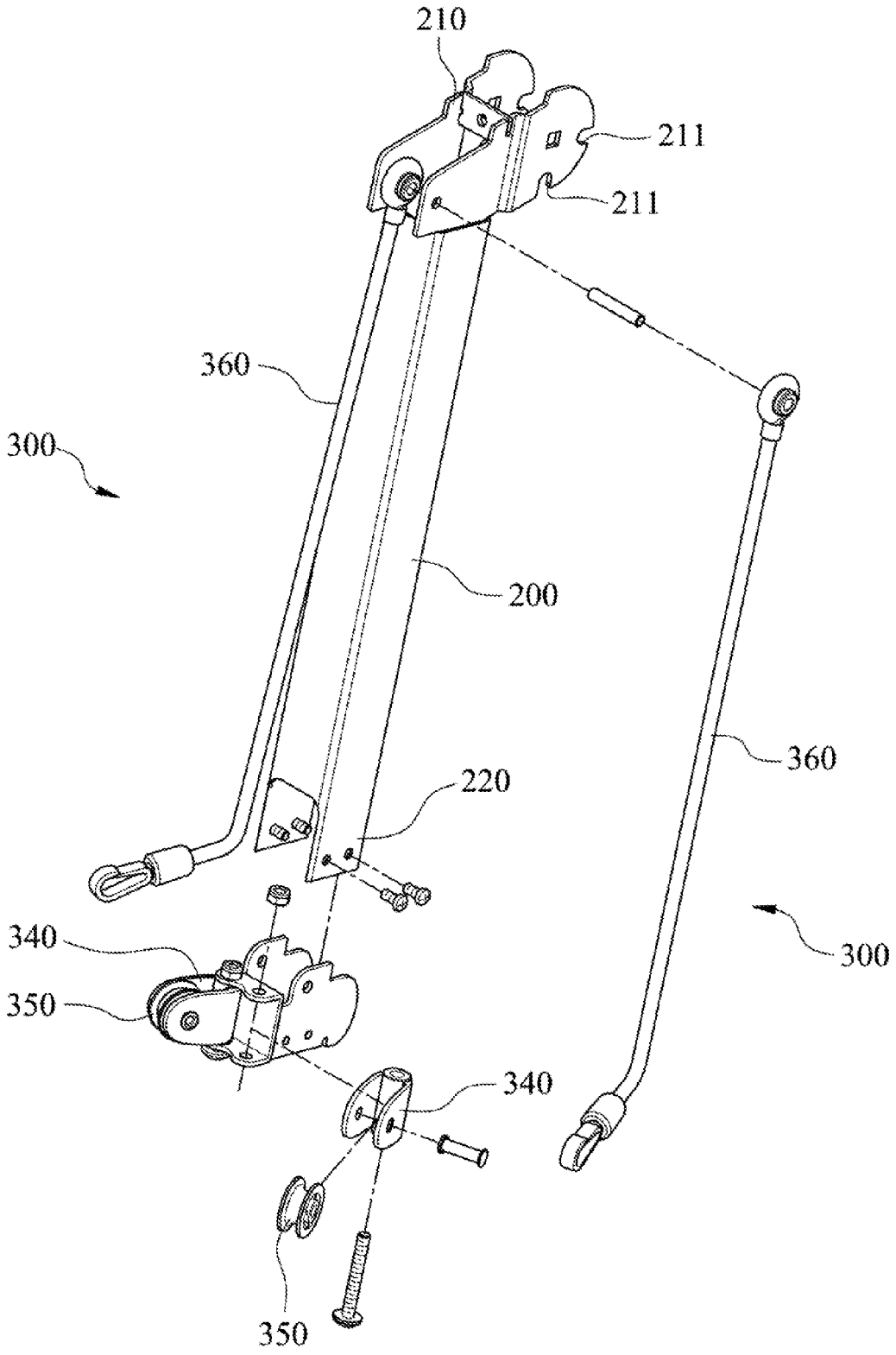
FIG. 13 is an exploded view of FIG. 12.

FIG. 12 is a partial perspective view of the rope base and the pulling sets of a rope pulling exercise apparatus according to another embodiment of the present disclosure. FIG. 13 is an exploded view of FIG. 12. Each pulling set 300 in the rope pulling exercise apparatus shown in FIG. 12-13 includes no intermediary pulley. Other elements with the same number are the same as mentioned before.

The rope 360 can be connected to the first end 210 of the rope base 200. The rope 360 is from the fixing location to extend along the exercise direction P and wound around the pivot-base pulley 350. Each pulling set 300 can further includes a pulling handle (not shown). The pulling sets 300 can be installed in a rope pulling exercise apparatus shown as FIG. 1 or FIG. 5 to replace the original pulling sets 300. Thus the operation is similar to FIGS. 6-7 and need not to be explained again here.

The embodiment disclosed in FIGS. 12 and 13 can also provide a user to exercise sit-up and rope pulling at the same time. The pivot base 340 can also swing in the swing direction R. So the rope 360 won't be wear easily. And the user can pull the rope 360 with smaller resistance, since the rope 360 won't be robbed by other components. The rope pulling exercise therefore can be performed more smoothly. Moreover, the pivot-base pulley 350 is installed around the outer edge of the rope pulling exercise apparatus, and it is easy and convenient to repair or replace the pivot-base pulley 350 or other parts. Only few elements needed to be uninstalled to reach the pivot-base pulley 350.

Therefore, the number of the intermediary pulleys of a rope pulling exercise apparatus according to the present disclosure is not limited by one, two, or three. One skilled in the art can increase or decrease the number of the intermediary pulleys in different scenario, or even no intermediary pulley at all. No matter what the number of the intermediary pulleys is, a rope pulling exercise apparatus according to the present disclosure can provide a user to exercise sit-up and rope pulling at the same time. The pivot base can swing in the swing direction R, so the rope won't be wear easily. Thus the user can pull the rope smoothly. Moreover, the intermediary pulleys and the pivot-base pulley are installed around the outer edge of the rope pulling exercise apparatus, so it is easy and convenient to repair or replace the pulleys or other parts.

According to the foregoing embodiment and example, the advantages of the present disclosure are described as follows.

1. A user is able to exercise sit-up and rope pulling at the same time. As a result, the user can exercise and train multiple muscle groups at the same time, such as abdominal muscle and arm muscle.

2. The exercise versatility is increased. A user may simply lie down and relax. The user can do sit-ups, rope pulling, or sit-ups and rope pulling at the same time. Exercising can be more interesting and versatile. Using a rope pulling exercise apparatus according to the present disclosure can thus help people develop exercise habit.

3. The wear of the rope can be greatly prevented, and the life of the rope pulling exercise apparatus can be prolonged. Meanwhile, a user can do rope pulling more smoothly.

4. The repair and maintenance are both easy and convenient.

5. The storage is easy and space-saving. The rope base 200 can be closed with the exercise base 100, i.e., the predetermined angle A can be zero. To store a rope pulling exercise apparatus according to the present disclosure is easy and required small space.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A rope pulling exercise apparatus, comprising:

an exercise base;

a rope base along an exercise direction having a first end and a second end, wherein the first end is pivotally connected to the exercise base;

a pivot base pivotally joined to the second end of the rope base, wherein a swing direction of the pivot base is relative to the exercise direction;

a pivot-base pulley pivotally connected at the pivot base;

a rope having a first end connected to the rope base and a second end for pulling along the exercise direction, wherein the rope is wound around the pivot-base pulley; and a backrest rotatably disposed on the exercise base about a shaft, wherein the backrest is synchronously drivable with the rope;

wherein the rope base is pivotable about the first end of said rope base between a first position in which the second end of the rope base is in close proximity to the exercise base, and a second position in which the second end of the rope base is spaced apart from the exercise base and points away from the surface on which the rope pulling exercise apparatus is supported;

wherein when the rope base is pivoted to the second position, the shaft about which the backrest is rotatably disposed on the exercise base is below the second end of the rope base.

2. The rope pulling exercise apparatus of claim 1, further comprising:

at least one intermediary pulley pivotally disposed at the first end or the second end of the rope base, wherein the rope is wound around the intermediary pulley and the pivot-base pulley.

3. The rope pulling exercise apparatus of claim 1, wherein the first end of the rope base has a fixing part for determining a predetermined angle between the rope base and the exercise base.

4. The rope pulling exercise apparatus of claim 1, wherein the rope is an elastic rope.

5. The rope pulling exercise apparatus of claim 1, further comprising: a pulling handle connected to the second end of the rope.

6. The rope pulling exercise apparatus of claim 5, wherein the pulling handle is removable from the rope.

7. A rope pulling exercise apparatus, comprising:

an exercise base;

a rope base along an exercise direction having a first end and a second end, wherein the first end is pivotally connected to the exercise base;

two pulling sets disposed side by side at the rope base, each pulling set comprising:

a pivot base pivotally joined to the second end of the rope base, wherein a swing direction of the pivot base is relative to the exercise direction;

a pivot-base pulley pivotally connected to the pivot base; and a rope having a first end connected to the rope base and a second end other end for pulling along the exercise direction, wherein the rope is wound around the pivot-base pulley; and a backrest rotatably disposed on the exercise base about a shaft, wherein the backrest is synchronously drivable with the rope;

wherein the rope base is pivotable about the first end of said rope base between a first position in which the second end of the rope base is in close proximity to the exercise base, and a second position in which the second end of the rose base is spaced apart from the exercise base and points away from the surface on which the rope pulling exercise apparatus is supported;

wherein when the rope base is pivoted to the second position, the shaft about which the backrest is rotatably disposed on the exercise base is below the second end of the rope base.

8. The rope pulling exercise apparatus of claim 7, wherein each pulling set further comprising:

at least one intermediary pulley pivotally disposed at the first end or the second end of the rope base, wherein the rope is wound around the intermediary pulley and the pivot-base pulley.

9. The rope pulling exercise apparatus of claim 7, wherein the first end of the rope base has a fixing part for determining a predetermined angle between the rope base and the exercise base.

10. The rope pulling exercise apparatus of claim 7, wherein the rope is an elastic rope.

11. The rope pulling exercise apparatus of claim 7, wherein each pulling set further comprising:

a pulling handle connected to the second end of the rope.

12. The rope pulling exercise apparatus of claim 7, wherein the pulling handle is removable from the rope.

13. A rope pulling exercise apparatus, comprising:

an exercise base;

a rope base along an exercise direction having a first end and a second end, wherein the first end pivotally is connected to the exercise base, and the first end of the rope base has a fixing part for determining a predetermined angle between the rope base and the exercise base; and two pulling sets disposed side by side at the rope base, each pulling set comprising: a pivot base pivotally joined to the second end of the rope base, wherein a swing direction of the pivot base is relative to the exercise direction;

a pivot-base pulley pivotally connected to the pivot base;

at least one intermediary pulley pivotally disposed at the first end or the second end of the rope base;

a rope having a first end connected to the rope base and a second end for pulling along the exercise direction, wherein the rope is wound around the intermediary pulley and the pivot-base pulley; and a pulling handle connected to the second end of the rope; and a backrest rotatably disposed on the exercise base about a shaft, wherein the backrest is synchronously drivable with the rope;

wherein the rope base is pivotable about the first end of said rope base between a first position in which the second end of the rope base is in close proximity to the exercise base, and a second position in which the second end of the rope base is spaced apart from the exercise base and points away from the surface on which the rope pulling exercise apparatus is supported;

wherein when the rope base is pivoted to the second position, the shaft about which the backrest is rotatably disposed on the exercise base is below the second end of the rope base.

14. The rope pulling exercise apparatus of claim 13, wherein the pulling handle is removable from the rope.

* * * * *